US005398875A

United States Patent [19]

Sverdlin

[11] Patent Number: 5,398,875

[45] Date of Patent: Mar. 21, 1995

[54] TERNARY PHASE, FLUID CONTROLLED, DIFFERENTIAL INJECTION PRESSURE FUEL ELEMENT

[76] Inventor: Anatoly Sverdlin, 240 E. Barbours Cut, P.O. Box 1322, LaPorte, Tex. 77571

[21] Appl. No.: 180,829

[22] Filed: Jan. 12, 1994

Related U.S. Application Data

[63] Continuation of Ser. No. 491, Jan. 5, 1993, abandoned.

[51] Int. Cl.[6] ..... F02M 39/00

[52] U.S. Cl. ..... 239/533.8

[58] Field of Search ..... 239/533.8, 88, 533.3, 239/533.5, 533.4, 95, 93

[56] References Cited

U.S. PATENT DOCUMENTS

| | | | |
|---|---|---|---|
| 2,291,939 | 0/1942 | Amery . | |
| 2,372,169 | 3/1945 | Amery | 239/533.8 X |
| 2,916,028 | 12/1959 | Mansfield . | |
| 3,796,206 | 3/1974 | Links . | |
| 3,943,901 | 3/1976 | Takahashi et al. . | |
| 4,069,800 | 1/1978 | Kanda et al. . | |
| 4,089,315 | 5/1978 | Lakra . | |
| 4,170,974 | 10/1979 | Kopse . | |
| 4,216,754 | 8/1980 | Lakra . | |
| 4,249,497 | 2/1981 | Eheim et al. . | |
| 4,359,032 | 11/1982 | Ohie . | |
| 4,667,638 | 5/1987 | Igashira . | |
| 4,911,127 | 3/1990 | Perr . | |
| 4,957,085 | 9/1990 | Sverdlin . | |
| 5,121,730 | 6/1992 | Ausman et al. . | |
| 5,125,580 | 6/1992 | Kronberger | 237/533.8 X |
| 5,235,954 | 8/1993 | Sverdlin . | |

FOREIGN PATENT DOCUMENTS

| | | | |
|---|---|---|---|
| 487403 | 2/1949 | Canada . | |
| 487903 | 10/1959 | Canada | 239/533.8 |
| 556140 | 9/1943 | United Kingdom | 239/533.8 |
| 2003549 | 3/1979 | United Kingdom | 239/533.8 |
| 2118624 | 11/1983 | United Kingdom | 239/533.3 |
| 2118624 | 11/1983 | United Kingdom . | |

*Primary Examiner*—Andres Kashnikow
*Assistant Examiner*—Kevin Weldon
*Attorney, Agent, or Firm*—Bush, Moseley, Riddle & Jackson

[57] ABSTRACT

Ternary phase, fluid controlled differential injection pressure fuel elements are provided for fuel injectors of the internal combustion engines. The fuel injection elements act as ternary phase, differential pressure, fluid controlled, hydraulic regulators. Fluid controlled pressurized control fluid acts directly at injection control valve and injection valve, independently governing an injection control valve and injection valve. The fuel injection elements may operate from either conventional crankshaft-camshaft driven fuel pumps or serve in fuel injection systems of internal combustion engines as single (ending) injection control elements for fuel injection systems. The operating principles of the fuel injection elements create a controllable hydrodynamic impact effect and differentiated injection pressure of variable fuel injection parameters. Injection parameters may be varied during engine operation at different MCR. With appropriate algorithm and governing means, fuel injection elements are able to control operating parameters of the internal combustion engines in real time.

26 Claims, 10 Drawing Sheets

TERNARY PHASE, FLUID CONTROLLED, DIFFERENTIAL INJECTION PRESSURE FUEL ELEMENT

This is a continuation of application Ser. No. 08/000,491, filed on Jan. 5, 1993, now abandoned.

FIELD OF THE INVENTION

This invention relates generally to fuel injectors utilized in internal combustion engines, and more particularly to ternary phase, fluid controlled, differential injection pressure fuel elements creating a controllable hydrodynamic impact effect and variable fuel injection parameters. A fuel injection element can be defined by operating principles, as a ternary phase, differential pressure, fluid controlled, hydraulic regulator. Fuel injection parameters can be responsive to sensed variable engine operating parameters in real time.

BACKGROUND OF THE INVENTION

In the past two or three decades diesel engines have increased power output per cylinder two to three times, but fuel injection systems which require very precise tuning and reliability have remained practically unchanged. The traditional design of the fuel system of such diesel engines includes a camshaft actuated from a crankshaft, individual plunger-type fuel pumps, fuel injectors, and different types of governors.

Lately designers and manufacturers of diesel engines, particularly marine diesel engines, have tried to introduce different types of electronic controls to existing conventional injection systems, such as camshaft driven unit injectors with electronic on-off controlled solenoid valves, or providing hydraulic actuators for conventional plunger-type fuel pumps. However, these recent improved fuel systems for diesel engines are more complicated, less controllable, more unreliable, and more uneconomical than heretofore.

Practically, when the operating condition of the fuel pumps in these fuel systems is changed due to cam, plunger or valve wear, the injection process becomes difficult to control regardless of the type of the associated electronic control. Each cylinder of the engine with this kind of injection system acts as an individual engine. With this arrangement it is difficult to balance power distribution between cylinders.

In multi-cylinder engines the power distribution between cylinders becomes uncontrollable which causes overloading of some cylinders and under loading of others. This results in failure of pistons, bearings, crankshaft, and other major engine parts and increased exhaust emissions. Variable injection timing (also known as VIT) devices using existing VIT controls to individual cylinders do not properly react to load and ambient conditions of various engine operations.

No engine or fuel injection equipment manufacturer heretofore, so far as is known, has attempted to directly control automatically the load sharing between individual cylinders, emission quality, and other major operating engine parameters. An electronically controlled functional algorithm or formula based on on-off principles cannot adequately react and govern existing conventional types of fuel injection systems. The very short time, only a few milliseconds, available for injection in diesel engines and the very high injection pressure, 1,000–2,000 bar, both present problems. They do not permit the utilization of a responsive and reliable system based on the principles of conventional injection systems elements. Fuel injection systems based on a crankshaft-camshaft drive and camshaft actuated fuel pumps are dynamically and hydraulically unresponsive, cannot be properly controlled, and react inadequately to changes which occur as a result of different load and ambient conditions during engine operation.

Other attempts to solve the problems associated with a fuel injection system operated from a crankshaft-camshaft drive have included a fuel injection system with two fuel injectors with different settings, or a complicated pre-injection pump arrangement. Both the pilot or pre-injection pump concept approaches have disadvantages. The high injection pressure (1,000–2,000 bars) acting on the plungers and associated valves causes them to deteriorate due to cavitation.

Conventional fuel injectors, by method of operation, are direct-acting relief valves. They operate on differential forces between fuel supply pressure and mechanical spring. In conventional fuel injection systems the load distribution between individual cylinders is uncontrollable. The failure of an individual fuel pump or fuel injector and related equipment on a multi-cylinder engine reduces the power of the engine by the amount which had been generated by the failed cylinder. The load which has been lost from the failed cylinder was consequentially distributed between the remaining normally operating cylinders. This causes uneven load distribution and overload to the entire engine when controlled by variable speed governors.

Variable speed governors, as analog devices, serve the purpose of maintaining a constant speed. So, in reaction to the failure of a single cylinder, variable speed governors increase fuel supply to the remaining operating cylinders causing overload and increasing torsional vibration and emissions of the engine. The disadvantage of these kinds of fuel systems has been proven over many years by different engine manufacturers. Fuel systems based on these principles are usually complicated, relatively unreliable and expensive.

Widely used in the engine industry are the conventional closed-type or Robert Bosch fuel injection elements. From a hydraulic definition they are direct-acting, unbalanced relief valves with different opening and closing characteristics. Injection pressure can be varied by these Bosch or closed-type fuel injection elements. Injection pressure of these valves depends only on the volume of the fuel pump and of the cross section of the injector atomizer holes.

Engine manufacturers have recently introduced another definition for the marine engine operation condition. The definition is called the mean continuous rating (MCR). Basically, this MCR definition allows marine diesel engines to operate at reduced power. For this reason, hundreds of fuel nozzles and fuel valves have been developed for the same engine. Practically, if the engine operator wants to change MCR of the engine new fuel injectors and fuel pumps need to be purchased. Only in this way can injection pressure be changed for existing fuel systems. However, changing MCR for an engine makes the previously purchased injection valves and related fuel injector equipment for that engine obsolete.

SUMMARY OF THE INVENTION

Briefly, the present invention provides a new and improved fuel injection element for fuel injectors utilized in internal combustion engines. The fuel injection techniques according to the present invention are based on different operating principles than the conventional, known fuel injection. Fuel injection elements according to the present invention can operate from a conventional crankshaft-camshaft drive, high pressure cycling fuel pumps, and related components for each individual cylinder. The fuel injection elements of the present invention can also operate from an electronically controlled fuel injection system.

The ternary phase, fluid controlled, differential injection pressure fuel element by governing means can control fuel injection pressure, fuel density, quantity, timing and other predetermined engine parameters. Thus, the fuel injection element can serve as the single distribution, metering, and control element of the fuel injection system.

The fuel injection element of the present invention by operational principles is a ternary phase, differential pressure, fluid controlled, hydraulic regulator which can be controlled by mechanical, fluid or electronic governing means.

Variable fluid control pressure acts directly against two independent valves of the fuel injection element: an injection control valve (ICV) and an injection valve (IV). The ICV and IV could be physically accommodated by a single or two independent elements. Differentiating the fuel and control fluid pressures operating conditions, control by the ICV and IV creates a controllable hydrodynamic impact effect phenomenon during fuel injection.

The injection control valve and injection valve normally remain in their closed positions in the injection element bodies, being urged into such a position under both biasing spring forces and fluid control pressure. A controllable hydrodynamic impact effect occurs when pressurized fuel from an external supply accumulates at the inlet port on the injection control valve. When the fuel pressure at the fuel inlet port becomes greater than the force of the predetermined control pressure, the injection control valve is urged to the open position. This condition creates a controllable hydrodynamic impact effect or controllable fluid hammer effect of the fuel. Fuel with high velocity and pressure then passes into the injection element body to act on the injection valve. The injection valve then opens because the force created by the controllable hydrodynamic impact effect is greater than the force of the predetermined control pressure, urging the injection valve to its open position. The injection valve opens and fuel is injected into the associated cylinder through the orifice holes of the atomizer.

At the end of the injection process, governed by external means, the injection control valve and fuel injection valve are urged back to seated, closed positions by the fluid control pressure.

The ternary phase, fluid controlled differential injection pressure fuel elements may be heated up when the engine stops by fuel recirculation and cooled by fuel during injection operation. Thus, the fuel injection elements do not require an additional cooling system as conventional fuel injection systems heretofore have required.

The ternary phase, fluid controlled, differential injection pressure fuel element of the present invention has the fuel injection control valve and the fuel injection valve operating under the variable control fluid pressure. This fluid pressure directly acting at precision guides of injection control valves and injection valves utilize a fluid tension effect as described in the invention titled "Fuel Injection System For Internal Combustion Engines," U.S. Pat. No. 4,957,085, the disclosure of which is included by this reference.

In the present invention, the fuel injection element creates controllable hydrodynamic impact effect and has the capability to control differential injection pressure. By these means, the density (mass) of the injected fuel droplets, as well as other predetermined injection parameters, can be varied during engine operation. The present invention may be utilized with two and four stroke slow, medium, high speed diesel engines and gas turbines. It may operate with conventional distilled-type diesel fuel and with heavy residual fuels, coal slurries and gaseous fuel for engines. It is possible to operate under severe operating conditions as the fuel injection control valve and the fuel injection valve operate with a fluid seal, created by the high fluid tension effect as described in aforementioned U.S. Pat. No. 4,957,085.

The fuel injection elements, according to the present invention for fuel injectors utilized in internal combustion engines, can operate in response to selected sensed engine operating parameters in real time. The fuel injection element has the capability to operate selectively with or without any type of crankshaft-camshaft actuated fuel distribution pump. The fuel injector includes a fuel injection element having a fuel injection control valve in direct fluid communication with pressurized control fluid. The pressurized fluid control source including a fluid control governing means is responsive to sensed operating parameters of the internal combustion engine.

A separate fuel injection control valve of the fuel injection element provides a rise of the fuel pressure, creating a controllable hydrodynamic impact effect and is phased for opening prior to the opening of the fuel injection valve under high fuel pressure utilizing controllable hydrodynamic impact effect phenomenon.

The fuel injection pressures of the fuel injection valve IV and the fuel injection control valve ICV are differentiated when pressurized control fluid is varied. The fuel injection control valve and the fuel injection valve are directly actuated upon a predetermined pressure differential between the pressurized fuel and the pressurized control fluid.

With the ternary phase, fluid controlled, differential injection pressure fuel element, it is not necessary to purchase and exchange new injection valves and fuel pumps in order to vary MCR. Differentiation of control fluid pressure is allowed in order to vary injection pressure for any desirable MCR without the exchange of fuel injection valves and pumps.

The fluid controlled, differential injection pressure fuel element may be defined as a ternary phase, differential pressure, fluid controlled, hydraulic regulator. If heavy fuel is utilized then heavy fuel recirculates continuously within the injector for heating the injector when fuel is not being injected into a cylinder of the engine and cooling injector during engine operation. This fuel injection element permits the engine to continuously operate on heavy fuels without switching to diesel fuel when the engine is operating at partial loads, as required with conventional fuel injection elements. The quantity of fuel, injection timing, duration, fuel injection density, and other predetermined operating injection parameters can be controlled in real time during the combustion process by a governing means. Variable signals from the governing means of the control are provided to governing pressure regulators for the control of fuel inlet pressure and the control fluid pressure. These governing means can directly control the fuel injection element.

The separate injection control valve is directly actuated by a predetermined pressure differential between pressurized fuel and pressurized control fluid, and provides differential levels of pressure control over the opening and closing of the fuel injection valve for controlling fuel injection parameters. The pressurized control fluid acts directly at the control fluid chambers of ICV and IV valves, being supplied by fluid control pressure means.

It is an object of this invention to provide a fuel injection controllable element for fuel injectors utilized in internal combustion engines which is responsive to continuously sensed predetermined engine operating parameters, and utilizes pressurized control fluid responsive to an output signal resulting from the sensed parameters.

Another object of this invention is the provision of such an injection element utilizing variable fuel and fluid pressure controls to create a controllable hydrodynamic impact effect for better injection and control of the fuel flow, injection pressure, fuel velocity, and other sensed predetermined injection parameters in real time.

Another object is the provision of a fuel injection element including a fuel injection valve and a fuel injection control valve responsive to a predetermined pressure differential between pressurized fuel and pressurized control fluid to create controllable hydrodynamic impact effect to control fuel atomization, and fuel injection pressure. Varying fluid control pressure at the fuel injection valve of the fuel injection element allows differentiation of the injection pressure.

Other objects, advantages, and features of this invention will be in part apparent and in part pointed out hereinafter in the following description and drawings.

BRIEF DESCRIPTION OF THE DRAWINGS

FIG. 9*a* is a performance oscillogram of a standard prior art mechanical injector in a B&W 8K90/GF marine engine, while

DESCRIPTION OF THE INVENTION

Figure 1:
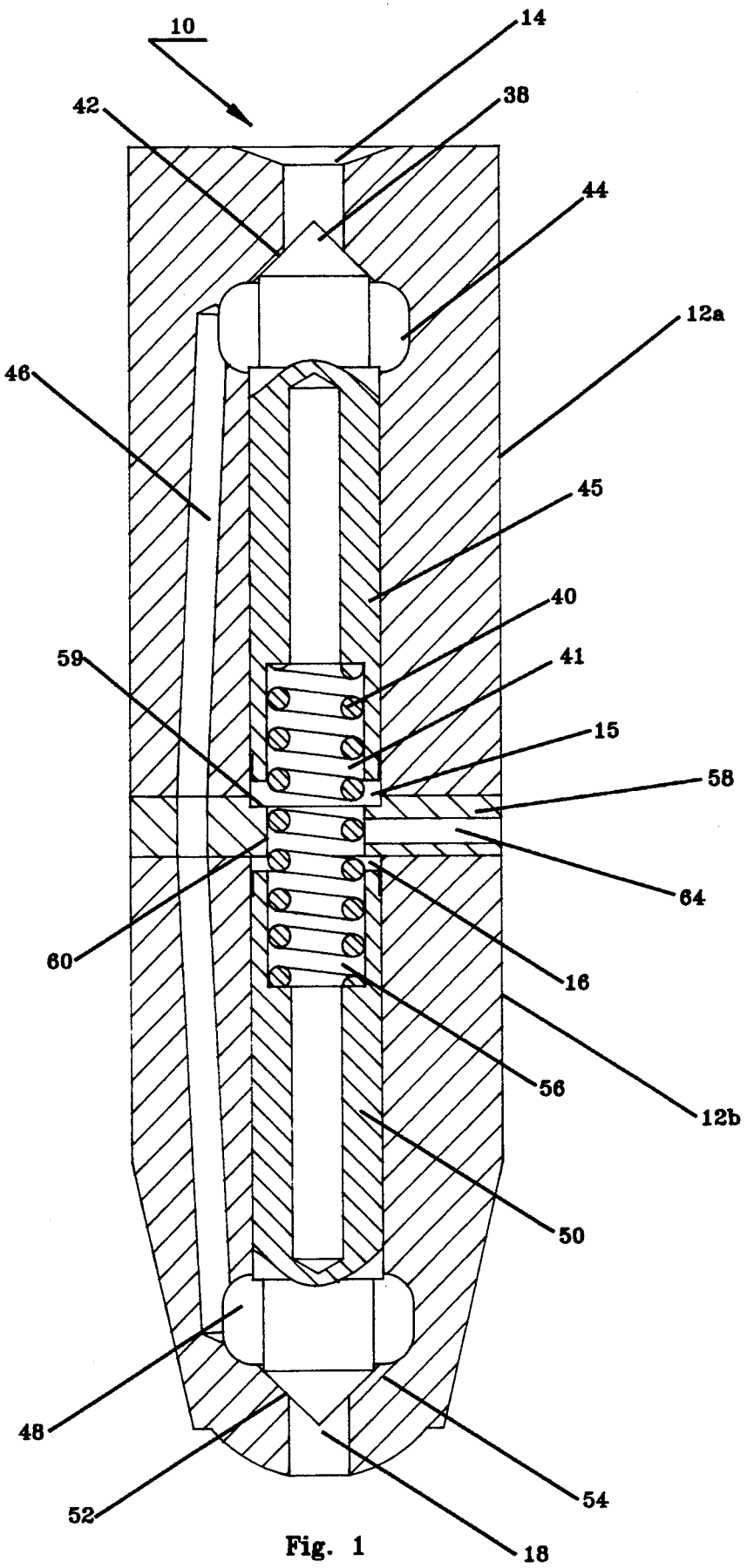
FIG. 1 is an elevation view, partly in cross-section, of a fuel injection element according to the present invention.
Figure 2:
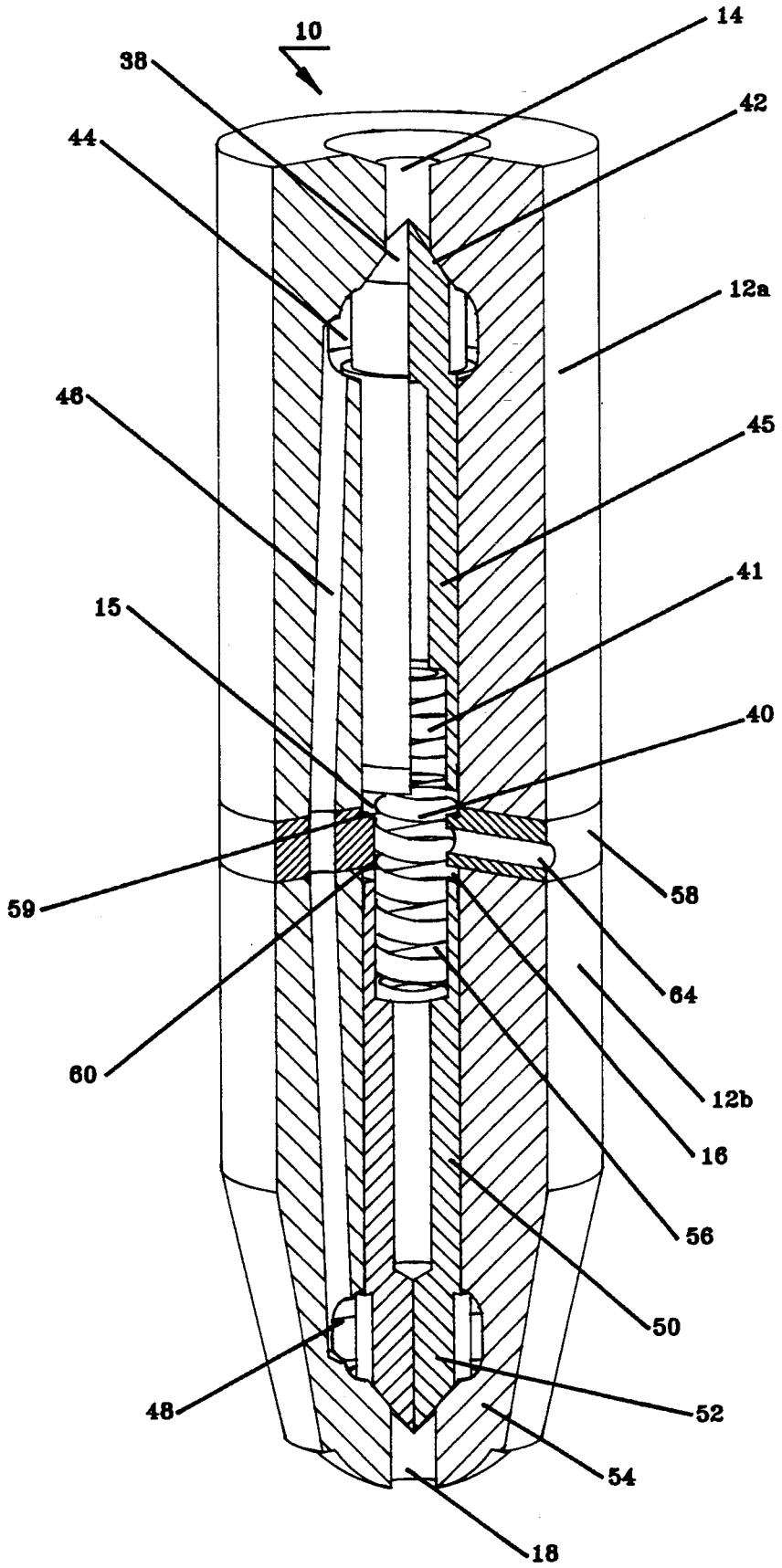
FIGS. 2 and 3 are isometric views, partly in cross-section, of the injection element of FIG. 1 showing the fuel injection control valve and injection valve.
Figure 3:
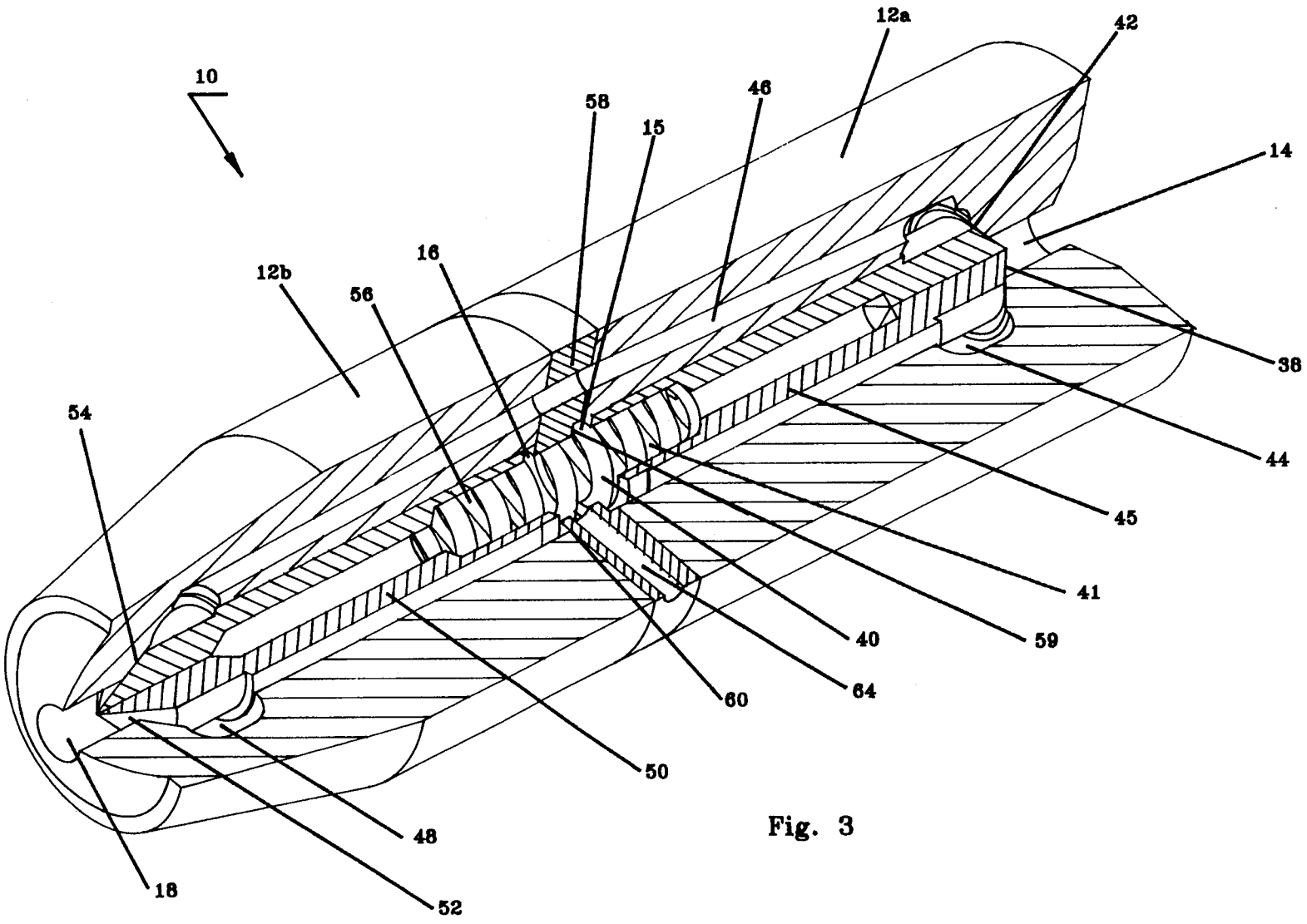
Figure 4:
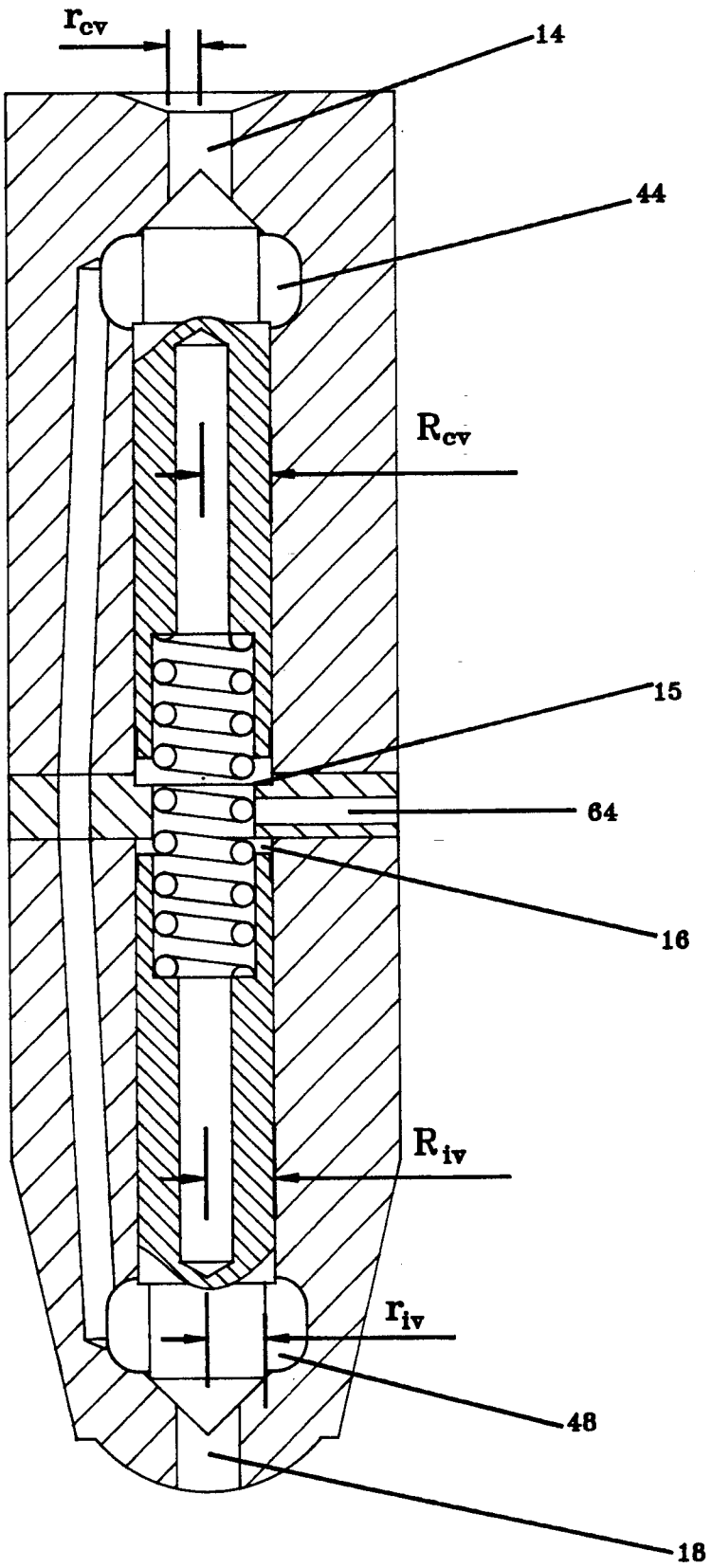
FIGS. 4 and 5*a*, 5*b*, 5*c*, 5*d* are elevation views, partly in cross-section, of the fuel injection element of FIG. 1 in the three phases of its operating cycle.

Briefly, the present invention is directed to a ternary phase, fluid controlled, differential injection pressure fuel element for fuel injectors in a multi-cylinder internal combustion engine which utilizes a pressurized control fluid for controlling the injection, creating controllable hydrodynamic impact effect conditions and capable of differentiating fuel injection pressure to a cylinder of the engine. Referring now particularly to FIGS. 1–3, fuel injection element 10 according to the present invention has an elongate ICV body generally indicated at 12*a*, having a fuel inlet port 14 at one end of ICV body 12*a* for the entry of pressurized fuel from a suitable fuel pressure source. An opposite end is IV body 12*b* of fuel injection element 10 which has a fuel discharge port 18 therein for the discharge of fuel into an associated cylinder of an internal combustion engine.

A fuel injection control valve 38 is normally urged by a biasing spring 40 toward a seated closed position on frusto-conical seat 42 in body 12*a*. The fuel injection control valve 38 has an elongated precision guide 45. At the end of injection control valve guide 45 is a control fluid chamber 15 in body 12*a*, formed within injection control valve guide 45 and a central bore 41 which receives the biasing spring 40.

An upper fuel chamber 44 is provided in ICV body 12*a* below valve seat 42 adjacent fuel injection control valve 38. Pressurized fuel may flow to upper fuel chamber 44 from fuel inlet port 14 when injection control valve 38 is open from its seated position. A suitable number of intermediate fuel passages such as the one shown at 46 are provided in body 12*a* to convey pressured fuel to a lower chamber 48 in body 12*b*. While only one fuel passage 46 is shown in FIGS. 1–3 between upper and lower fuel chambers 44 and 48, a plurality of fuel passages 46 are usually provided, preferably either two, four or six.

A fuel injection valve precision guide 50 according to the present invention has an end in a control fluid chamber 16 in injection valve body 12*b*. The fuel injection valve guide 50 has a valve 52 adapted normally to seat closed on frusto-conical seat 54 of body 12*b* to control fuel flow to fuel discharge port 18. Fuel injection valve guide 50 has a central bore 56 receiving an opposite end of biasing spring 40 which urges fuel injection valve 52 toward a seated, closed position on seat 54. A thrust plate 58 mounted between end portions 12*a* and 12*b* of fuel injection element 10. Injection control valve guide 45 and injection valve guide 50 have stroke limiting surfaces 59 and 60 formed on thrust plate 58 to engage them. The stroke limiting surfaces 59 and 60 limit rearward movement of injection control valve guide 45 and fuel injection valve guide 50, respectively, from their seated position to an open position.

Figure 5D:
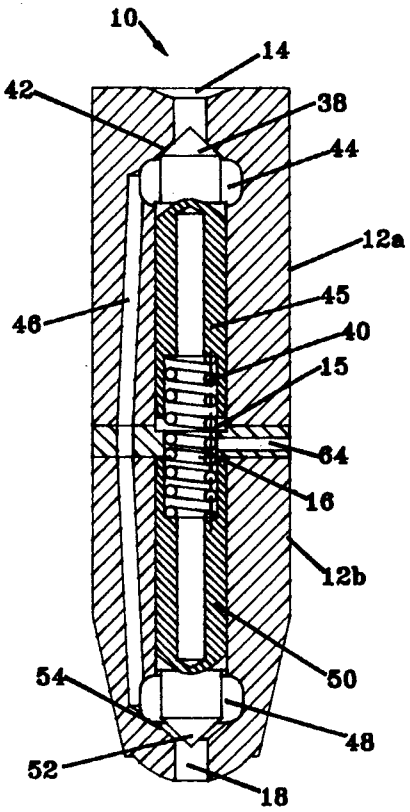
Figure 5C:
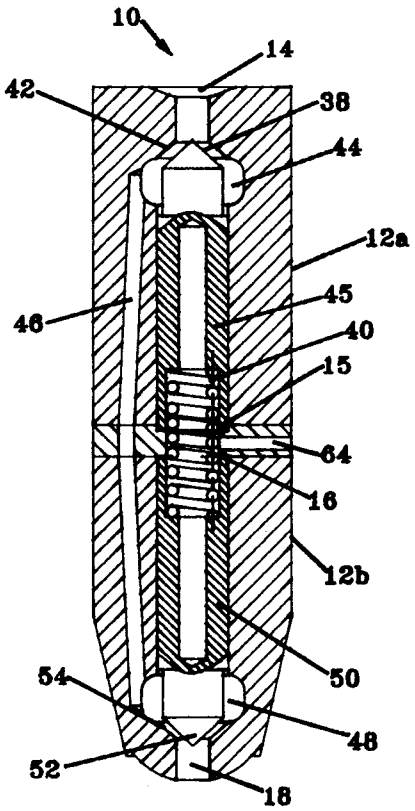
Figure 5B:
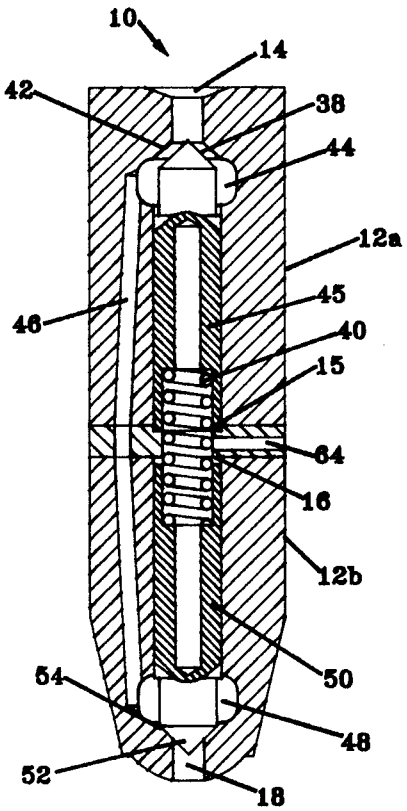
Figure 5A:
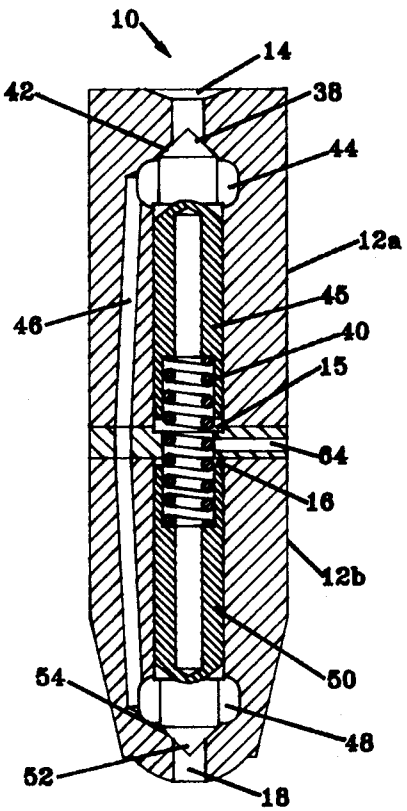

A pressurized control fluid is provided entry into fuel injection element 10 through a control fluid inlet passage 64 in thrust plate 58 to continuously, directly urge fuel injection valve guide 50 with injection valve 52, and fuel injection control valve guide 45 with injection control valve 38 toward seated closed positions (FIG. 5*a*). Biasing spring 40 also urges the injection control valve 38 and injection valve 52 toward seated, closed positions. At the beginning of the injection process, governed by external means, injection control valve 38 is urged to open position at a predetermined pressure differential between the pressurized fuel and the pressurized control fluid, and the urging of spring 40. This condition represents phase one (FIG. 5*b*) of controllable fuel injection. Thereafter, fuel injection valve 52 is urged to an open position at a predetermined pressure differential between the pressurized fuel and the pressurized control fluid. At this time injection control valve 38 remains in an open position. In this condition, injection control valve 38 and fuel injection valve 52 are open simultaneously. This condition represents phase two (FIG. 5*c*) of controllable fuel injection. At the end of the injection process, governed by external means, the pressurized control fluid inside control fluid chamber 15, directly acting against injection control valve guide 45 urges injection control valve 38 towards a seated, closed position overriding the decreasing force of the pressurized fuel. Fuel injection valve 52 remains open. This condition represents phase three (FIG. 5*d*) of controllable fuel injection. Fuel pressure inside the lower fuel chamber 48 decreases, control fluid pressure directly acting at injection valve guide 50, at control fluid chamber 16, urging fuel injection valve 52 towards its seated, closed position (FIG. 5*a*). The pressure of the pressurized control fluid can be varied continuously from output fluid controlled pressure signals from an external governing means responsive to monitors and sensors for sensing predetermined engine operating conditions in real time.

By such external means the variable pressure fluid control signal varies the injection pressure and injected fuel density. Other injection parameters can also be varied in real time depending on variable signal characteristics. The differentiation of fluid control pressure, allows the control of the injection process. It will be explained further hereinafter.

The opening and closing of injection control valve 38 and fuel injection valve 52 occurs in three separate phases having variable time intervals therebetween. Injection control valve 38 opens first, FIG. 5(*b*), followed by the opening of fuel injection valve 52, FIG. 5(*c*). Likewise, injection control valve 38 closes first, FIG. 5(*d*), followed by the closing of fuel injection valve 52.

The fuel injection element 10 by thus functioning can be defined as a ternary phase, differential pressure, fluid controlled, hydraulic regulator. The ternary phase, fluid controlled, differential injection pressure fuel element 10 of the present invention utilizing high tension effect and creates a controllable hydrodynamic impact phenomenon, and allows for the capability to vary injection parameters of injected pressurized fuel into an associated cylinder of the multi-cylinder internal combustion engines, as has been set forth. This operational cycle will first be explained in terms of the forces acting on the valves 38 and 52 of fuel injection element 10.

Operating Conditions of the Ternary Phase, Fluid Controlled, Differential Injection Pressure Fuel Element—FIGS. 4 and 5*a*, 5*b*, 5*c*, and 5*d*

Definitions

ICV—Injection control valve 38

IV—Injection valve 52

$P_c$—Fluid control pressure at control fluid inlet passage 64

$P_{in}$—Fuel inlet pressure at fuel inlet port 14

$P_{inj}$—Fuel injection pressure at fuel discharge port 18

$r_{cv}$—Radius of fuel inlet port 14 of the ICV 38

$R_{cv}$—Radius of ICV guide 45

$r_{iv}$—Radius of injection valve 52

$R_{iv}$—Radius of injection valve (IV) guide 50

$IN_a$—Area cross section of ICV fuel inlet port 14

$CV_a$—Area cross section of ICV guide 45

$CV_{dif}$—Area cross section of ICV differential between fuel inlet port 14 and ICV guide 45

$IV_{dif}$—Area cross section of IV differential between fuel discharge port 18 and IV guide 50

$IV_{ip}$—Area cross section of the IV 38

$F_1$—Acting force at fuel inlet port 14 area of the ICV 38

$F_2$—Acting force at control fluid chamber 15 area of the ICV guide 45

$F_3$—Acting force at control fluid chamber 16 area of the IV guide 50

$F_4$—Acting force at differential area of the IV 52

$F_5$—Acting force at fuel inlet port 14 at area of ICV 38 during injection (ICV 38 open)

$F_6$—Acting force at differential area of the IV 52 during injection (IV 52 open)

$F_7$—Acting force at combined area of IV 52 during injection (IV 52 open)

Having the foregoing definitions in mind, an operating cycle of the ternary phase, fluid controlled,differential injection pressure fuel injection element 10 according to the present invention can now be illustrated with reference to the drawings. An initial condition of the operational cycle of the fuel injection element 10 is that of the operating condition at fuel inlet port 14 of injection control valve 38 before fuel injection. This condition is illustrated in FIG. 5(*a*). The forces and pressure relationships are as follows:

$$P_{in}<P_c$$

$$IN_a=\pi r_{cv}^2;$$

$$F_1=IN_aP_{in}$$

One can also consider the conditions at the control fluid chamber 15 of the injection control valve guide 45.

$$P_c>P_{in}$$

$$CV_a=\pi R_{cv}^2$$

$$F_2=CV_aP_c,\ CV_a>IN_a$$

$$\text{so}F_2>F_1$$

when injection control valve 38 is closed as shown in FIG. 5(*a*).

The pressure and force relationships at this state or condition at the control fluid chamber 16 of injection valve guide 50 are as follows:

$$P_{in}<P_c$$

$$IV_a=\pi R_{iv}$$

$$F_3=IV_aP_c$$

The pressure and force relationships at the injection valve 52 and condition inside lower fuel chamber 48 of the IV body 12*b*.

$$P_c>P_{in}$$

$$IV_{dif}=\pi R_{iv}^2-\pi r_{iv}^2$$

$$F_4=IV_{dif}P_{in}$$

$$\text{but } P_{in}=0;\ P_c=\max;$$

$$\text{so } F_3>F_4;$$

with injection valve 52 closed as shown in FIG. 5(*a*).

Phase One: Injection control valve 38 open: Injection valve 52 closed, FIG. 5(*b*)

The beginning of the injection process is determined by external injection governing means; accumulating predetermined fuel injection pressure at the fuel inlet port 14 of injection control valve 38 at the beginning of injection. With the accumulating fuel pressure from pressure source increasing, the force and pressure relationships are:

$$P_{inj} > c$$

$$IN_a = \pi r_{cv}^2$$

$$F_5 = IN_a P_{inj};$$

$$\text{so } F_5 > F_4.$$

Accumulated high fuel pressure creates a controllable hydrodynamic impact effect condition at the fuel inlet port 14 when injection control valve 38 will open. Injection control valve 38 now opens and fuel with high pressure and velocity passes into upper fuel chamber 44 of the injection control valve body 12*a* and by passages 46, passes inside lower fuel chamber 48 of IV body 12*b*. This condition is illustrated in FIG. 5(*b*).

Injection control valve 38 remains open because:

$$P_{inj} > P_c;$$

now $P_{inj}$ is acting against combined areas of the fuel inlet port 14 of the injection control valve 38 and ICV guide 45 (FIG. 5(*b*)).

$$IN_a + CV_{dif} = CV_a;$$

$$\text{so } F_5 > F_2$$

Phase Two: Injection control valve 38 open: Injection valve 52 open, FIG. 5(*c*)

The condition inside lower fuel chamber 48 of injection valve 52 is now considered. At this time, the accumulated high pressure fuel at pressure $P_{inj}$ is now acting at differential area $IV_{dif}$ of the IV.

$$P_{inj} > P_c$$

$$IV_{dif} = \pi R_{iv}^2 - \pi r_{iv}^2$$

$$F_6 = P_{inj} IV_{dif}$$

$$F_6 > F_3$$

The injection valve 52 is open, and fuel is being injected (FIG. 5(*c*)).

The conditions at control fluid chamber 16 of the injection valve guide 50 during injection can now be considered. Because injection valve 52 is now open, fuel pressure now acts upon combined areas of the injection valve 52 and IV guide 50.

$$P_{inj} > P_c$$

$$IV_{dif} + IV_{ip} = IV_a$$

$$F_7 = P_{inj} IV_a$$

$$F_7 > F_3$$

Injection valve 52 thus remains open, and injection continues (FIG. 5(*c*)). The injection control valve 38 and injection valve 52 are now open simultaneously (FIG. 5(*c*)). At the end of the injection process, determined by external governing means, fuel pressure $P_{inj}$ decreases at the fuel inlet port 14 of the injection control valve 38. At this time:

$$P_c > P_{inj}; \text{ and}$$

$$F_3 > F_5$$

so that injection control valve 38 will now be closed. This condition is shown in FIG. 5(*d*).

Phase Three: Injection control valve 38 closed: Injection valve 52 open, FIG. 5(*d*)

Injection pressure $P_{inj}$ decreases inside lower fuel chamber 48 at IV body 12*b* of the injection valve 52, because the injection valve is still open to the fuel discharge port 18. Thus:

$$P_c > P_{inj}; \text{ and}$$

$$F_3 > F_7.$$

Because of this, the injection valve 52 now closes and conditions return to those illustrated at FIG. 5(*a*). Differentiation of the pressures of $P_c$ and $P_{inj}$ creates controllable hydrodynamic impact effect conditions, allows differentiated injection pressure, varies injection timing and predetermines injection parameters in real time by means of an injection governing algorithm. These parameters can be adjusted according to changes in engine operating conditions during operation, as has been set forth.

Figure 6:
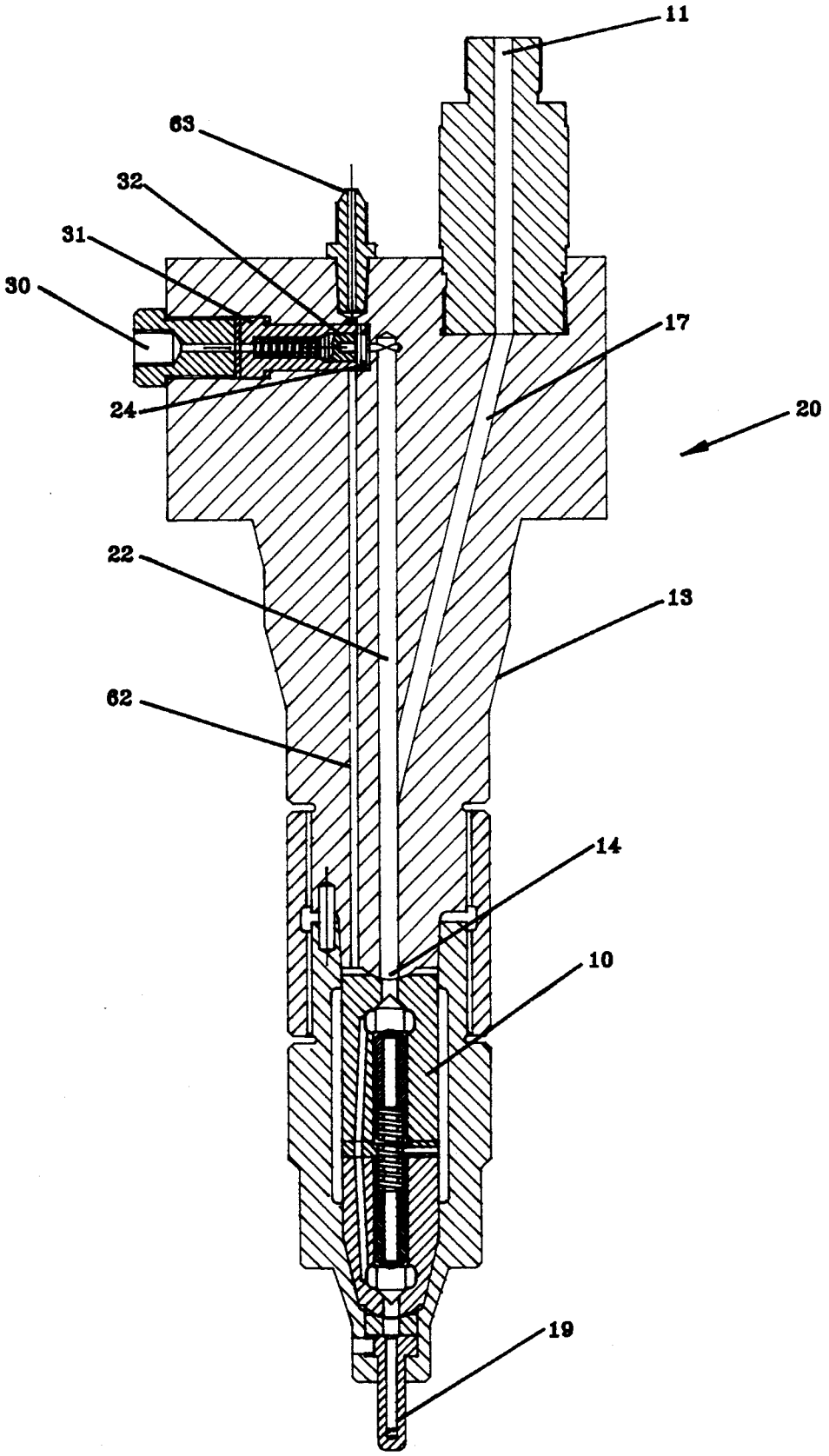
FIGS. 6 and 7 are elevation views, taken partly in cross-section, of fuel injectors with fuel injection element, according to the present invention for engines for heavy fuel operating with recirculation valves.
Figure 7:
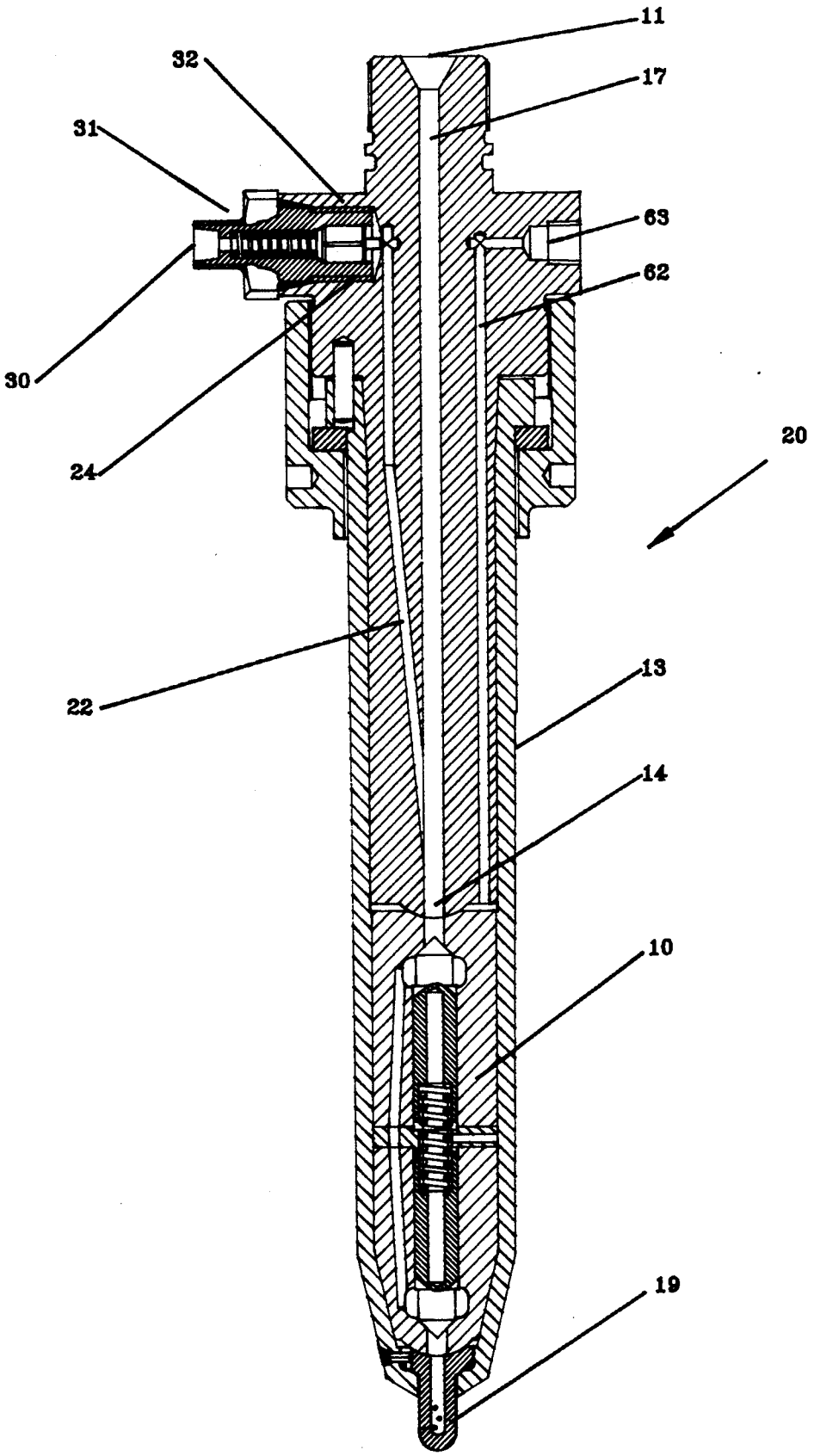

Referring now particularly to FIGS. 6 and 7 which show fuel injector generally indicated at 20, with ternary phase, fluid controlled, differential injection pressure fuel elements, for RTA Sulzer and MAN-B&W marine engines operating on heavy fuels. Injectors have elongate bodies 13 having fuel inlet port 11 at one end of body 13 for fuel passage 17 for pressurized fuel. The control fluid for the fuel injection element is supplied through control fluid inlet passage 63. The other end of body 13 has a fuel connecting port 14 with connection to port therein for the supply of fuel into a fuel injection element 10. The fuel is continuously recirculated when heavy fuel is in use and not being discharged into the cylinder. Heavy fuel flows through passage 22, annular chamber 24 of valve 32 for return through outlet port 30. A recirculation valve is shown generally at 32 having an annular chamber 24 in axial alignment with recirculation valve body 31 and having clearance between valve 32 and body 31 as shown in FIGS. 6 and 7, to permit heavy fuel flow through outlet port 30 for recirculation. Injection occurs through atomizer 19 during fuel injection element 10 operation.

Figure 8:
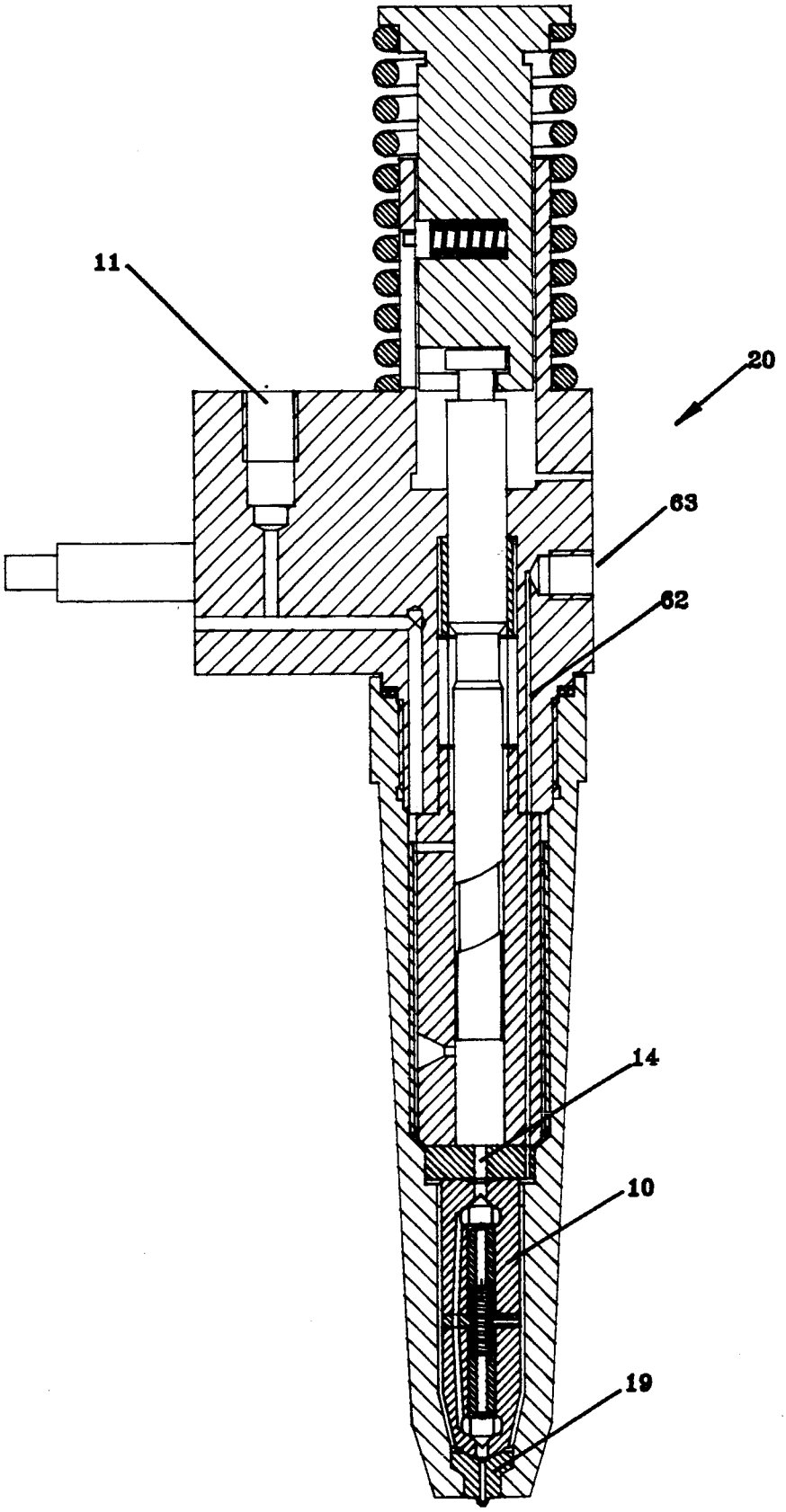
FIG. 8 is an elevation view, taken partly in cross-section, of fuel unit injector with fuel injection element, according to the present invention.

Referring now to FIG. 8 which shows a unit injector, generally indicated at 20, with ternary phase, fluid controlled, differential injection pressure fuel elements. These unit injectors 20 can be utilized, as example, for EMD-645E, Caterpillar 3500, 3600 series engines, Detroit Diesel engines, etc. or the like. Practically with the described fuel injection element it is possible to install for engines from 5–6,000 Hp per cylinder. Unit injectors operate in the same manner as the above described normal injectors.

Figure 9A:
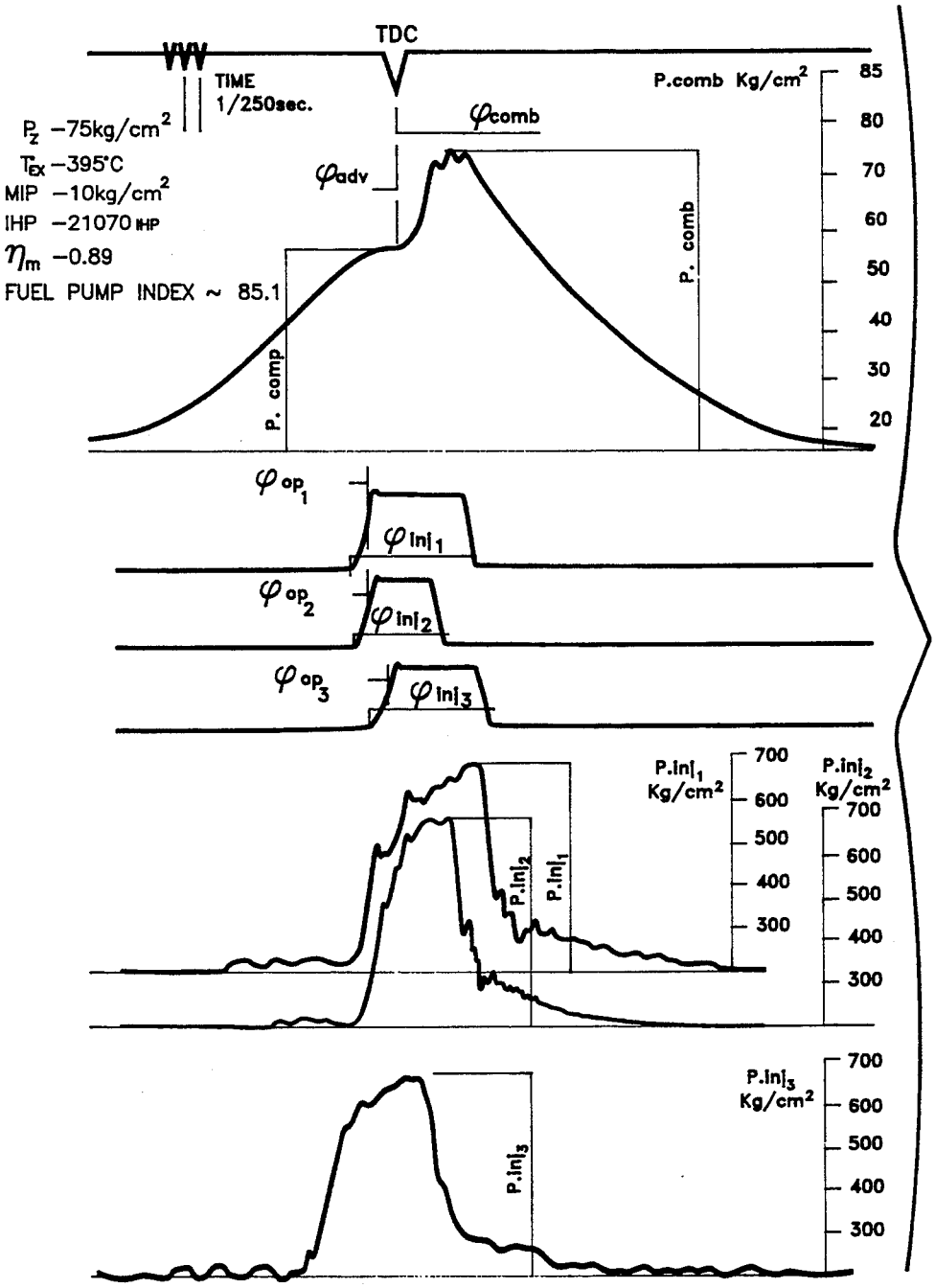
Figure 9B:
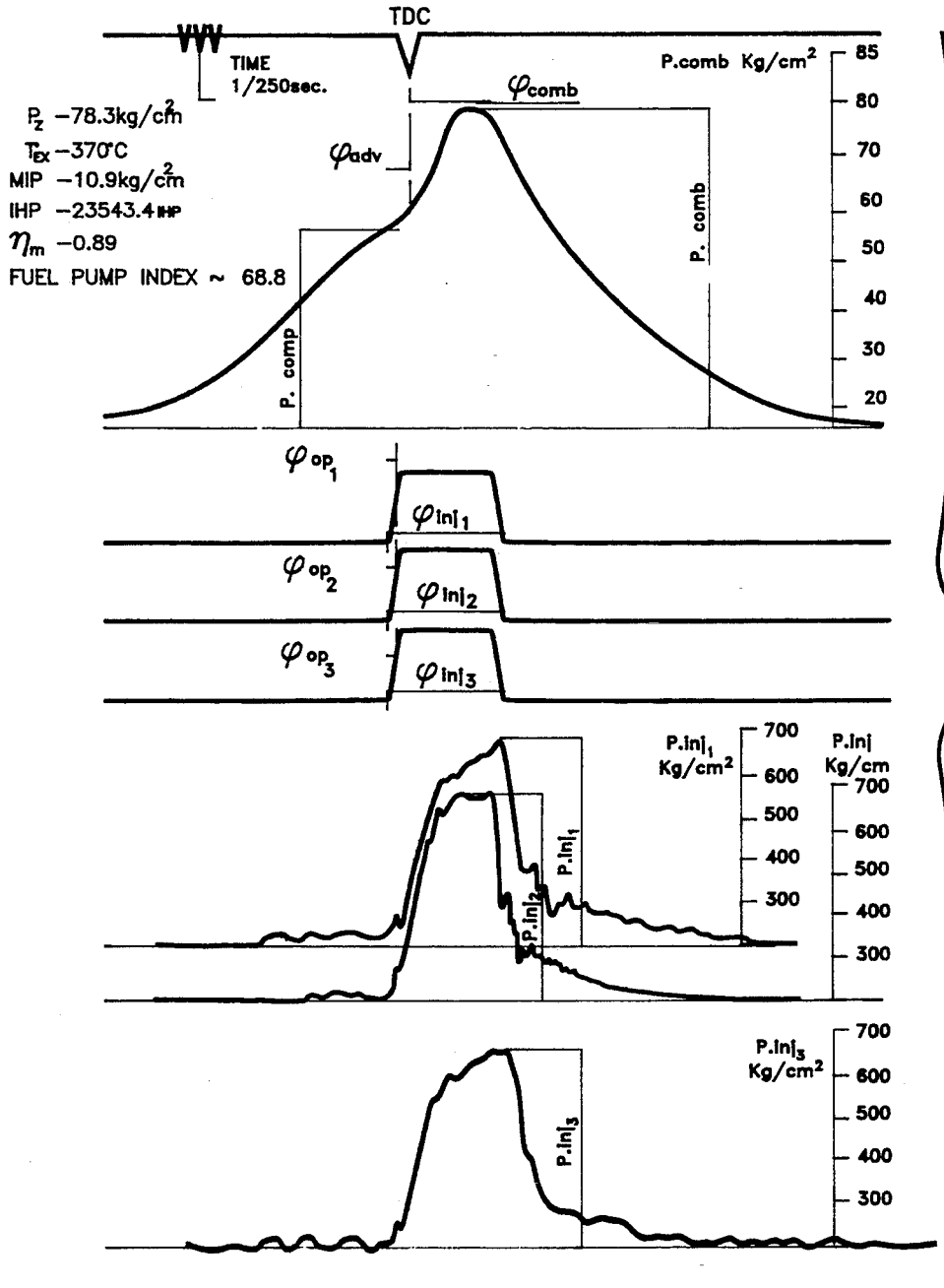
FIG. 9*b* is a performance oscillogram of a ternary phase, fluid controlled, differential injection pressure fuel elements according to the present invention in the same marine engine type.

As has been proven by experiments, controllable injection is achieved under the following conditions as shown in FIGS. 4 and 5*a*, 5*b*, 5*c*, 5*d*. FIGS. 9*a* and 9*b* are performance oscillograms of B&W 8K90/GF marine engine combustion and fuel injection oscillograms. During a comparison test the engine was operating at 106 RPM with specified load. (The B&W 8K90/GF marine engine has three fuel injectors per cylinder operating from one fuel pump.) During operation with mechanical injectors, the injection time, pressure, and duration for each injector was different and unstable (FIG. 9*a*). The injection valves needle lifts (Ψop1, Ψop2, and Ψop3) had different times. Injection duration was very different (Ψinj1, Ψinj2, and Ψinj3). Closing of the injectors had different times. This can mainly be attributed to the differences in control spring forces between the injectors. The indicator diagram shows very unstable combustion close to TDC. The combustion process clearly follows the pattern of each injector's operation. Ψadv had a long delay and Ψcomb was unstable. At 106 RPM the fuel pump index was ≈85–89.

The mechanical injectors were then removed and fuel injectors with ternary phase, fluid controlled, differential injection pressure fuel elements were installed. The performance curve (FIG. 9*b*) showed great improvement in engine operation. Fuel pressure at each injector was more stable in comparison to mechanically controlled injectors. Injection valves 52 had uniform lift time (Ψop1, Ψop2, and Ψop3), uniform duration (Ψinj1, Ψinj2, and Ψinj3), and practically the same closing time. The indicator diagram shows an absolutely stable combustion process (Ψadv and Ψcomb), an increased peak pressure of about 3–5 bars, an exhaust temperature of 20°–30° C. lower than specified, and a fuel pump index of ≈68.8 (representing an ≈32% less fuel consumption per same engine load conditions than with mechanical injectors).

Having described the invention above, various modifications of the techniques, procedures, material and equipment will be apparent to those in the art. It is intended that all such variations within the scope and spirit of the appended claims be embraced thereby.

I claim:

1. A ternary phase, fluid controlled, differential injection pressure fuel element for fuel injectors utilized in internal combustion engines, comprising:

a fuel injection element body having a fuel inlet port to receive pressurized fuel and a fuel discharge port, to inject fuel into cylinders of internal combustion engines;

said injection element body further having an upper fuel chamber therein adjacent said fuel inlet port;

said injection element body further having a lower fuel chamber therein adjacent said fuel discharge port and fuel passages connecting said upper fuel chamber and said lower fuel chamber;

a fuel injection control valve in said injection element body and having a seated closed position between said fuel inlet port and said upper fuel chamber to provide a buildup of fuel pressure at said fuel inlet port;

a fuel injection valve in said injection element body and having a seated closed position between said lower fuel chamber and said fuel discharge port;

means admitting a pressurized independent hydraulic control fluid to urge said fuel injection control valve and said fuel injection valve to their seated closed positions in opposed relation to said pressurized fuel and varying the pressure of said pressurized control fluid continuously during operation of the engine in response to selected sensed operating conditions of said engine, the pressure of said pressurized fuel at said fuel inlet port varying continuously in response to changes in the pressure of said pressurized control fluid to provide opening and closing of said fuel injection control valve at varying fuel pressures;

said fuel injection control valve moving from its seated position in response to a pressure differential between the pressurized fuel and the pressurized hydraulic control fluid to create controllable hydrodynamic impact effect of injected fuel and allow fuel to pass into said upper fuel chamber and fuel passages to said lower fuel chamber; and thereafter said fuel injection valve moving from its seated position in response to a pressure differential between the fuel in said lower fuel chamber and the pressurized hydraulic control fluid to control injection parameters of the injected fuel and control injection of said fuel to said fuel discharge port.

2. The fuel injection element of claim 1, wherein said means admitting pressurized control fluid comprises:

a control fluid inlet passage formed in said injection element body for pressurized control fluid to enter same and act directly on said fuel injection control valve and said fuel injection valve.

3. The fuel injection element of claim 2, wherein said means admitting pressurized control fluid comprises:

an injection control valve control fluid chamber formed in said injection element body in fluid communication with said control fluid inlet passage for receiving pressurized control fluid.

4. The fuel injection element of claim 3, wherein:

said injection control valve is mounted in said injection control valve control fluid chamber.

5. The fuel injection element of claim 4, further including:

control pressure means in said injection control valve control fluid chamber, directly urging said fuel injection control valve into the seated position.

6. The fuel injection element of claim 5, wherein:

said control pressure means comprises a bias spring.

7. The fuel injection element of claim 2, wherein said means admitting pressurized control fluid comprises:

an injection valve control fluid chamber formed in said injector body in fluid communication with said control fluid inlet passage for receiving pressurized control fluid.

8. The fuel injection element of claim 7, wherein:

said injection valve is mounted in said injection valve control fluid chamber.

9. The fuel injection element of claim 8, further including:

control pressure means in said injection valve control fluid chamber directly urging said fuel injection valve into the seated position.

10. The fuel injection element of claim 9, wherein:

said means for urging comprises a bias spring.

11. The fuel injection element of claim 1, wherein said means admitting pressurized control fluid comprises:

a control fluid inlet passage formed in said injection body for pressurized control fluid to enter same and concurrently directly act on said fuel injection control valve and said fuel injection valve.

12. The fuel injection element of claim 11, wherein said means admitting pressurized control fluid comprises:

a control fluid chamber formed in said injection element body in direct fluid communication with said control fluid inlet passage for receiving pressurized control fluid; and a control fluid chamber formed in said injector body in direct fluid communication with said control fluid inlet passage for receiving pressurized control fluid.

13. The fuel injection element of claim 1, wherein:

said fuel inlet port has a cross-sectional area in said injection element body smaller than a cross-sectional area of said injection control valve guide cross-sectional area, to create differential pressure control conditions at said fuel inlet port.

14. The fuel injection element of claim 1, wherein:

said fuel inlet port has a cross-sectional area in said injection element body smaller than a cross-sectional area of said injection control valve.

15. The fuel injection element of claim 1, wherein:

said fuel discharge port has a cross-sectional area in said injector body smaller than a cross-sectional area of said injection valve guide cross-sectional area.

16. The fuel injection element of claim 1, wherein:

said fuel discharge port has a cross-sectional area in said injector body smaller than a cross-sectional area of said fuel injection valve for varying injection parameters.

17. A fuel injection element for fuel injectors utilized in internal combustion engines comprising:

an injection dement body having a fuel inlet port for pressurized fuel and a fuel discharge port;

said injection element body further having an upper fuel chamber therein adjacent said fuel inlet port;

said injection element body further having intermediate fuel passages connected to said upper fuel chamber;

a fuel injection control valve in said injection element body and having a seated closed position between said fuel inlet port and said upper fuel chamber to provide a buildup of fuel pressure at said fuel inlet port;

means admitting a pressurized independent hydraulic control fluid to directly urge said fuel injection control valve to its seated position in opposed relation to said pressurized fuel and varying the pressure of said pressurized control fluid supplied to said injection element body continuously during operation of the engine in response to selected sensed operating conditions of said engine, the pressure of said pressurized fuel at said fuel inlet port varying continuously in response to changes in the pressure of said pressurized control fluid to provide opening and closing of said fuel injection control valve at varying fuel pressures and varying control fluid pressures;

said fuel injection control valve moving from its seated position in response to a pressure differential between the pressurized fuel and the pressurized hydraulic control fluid to allow fuel to pass into said upper fuel chamber and fuel passages to said lower fuel chamber; and means for permitting exit of pressurized fuel from said fuel discharge port.

18. A fuel injection element for injection of fuel into the cylinders of a multi-cylinder internal combustion engine, comprising:

an injection element body for each of the fuel injectors of the engine, each said injection element body having a fuel inlet port for pressurized fuel and a fuel discharge port;

each said injection element body further having an upper fuel chamber therein adjacent said fuel inlet port;

each said injection element body further having a lower fuel chamber therein adjacent said fuel discharge port and fuel passages connecting said upper fuel chamber and said lower fuel chamber;

a fuel injection control valve in each said injection element body and having a seated closed position between said fuel inlet port and said upper fuel chamber to provide a buildup of fuel pressure at said fuel inlet port;

a fuel injection valve in each said injector body and having a seated closed position between said lower fuel chamber and said fuel discharge port;

control pressure means admitting a pressurized independent hydraulic control fluid directly urging said fuel injection control valve and said fuel injection valve to their seated positions in opposed relation to said pressurized fuel, the pressure of said pressurized control fluid supplied to said fuel injection element varying continuously during operation of the engine in response to selected sensed operating conditions of said engine, the pressure of said pressurized fuel at said fuel inlet port varying continuously in response to changes in the pressure of said pressurized control fluid to permit opening and closing of said fuel injection control valve at varying control fluid pressures and varying fuel pressures;

said fuel injection control valve first moving from its seated position in response to a pressure differential between the pressurized fuel and the pressurized hydraulic control fluid to allow fuel to pass into said upper fuel chamber and fuel passages to said lower fuel chamber; and said fuel injection valve then moving from its seated position in response to a pressure differential between the fuel in said lower fuel chamber and the pressurized hydraulic control fluid to allow the fuel to exit said fuel discharge port for entry into one of the engine cylinders.

19. A fuel injection element for the injection of fuel into a cylinder of an internal combustion engine and operated in response to fluid pressure differentials between pressurized fuel and a separate independent pressurized control fluid each supplied to said fuel injection element at a variable pressure dependent on selected sensed operating conditions of the engine; said fuel injection element comprising:

a body having a fuel inlet port to receive pressurized fuel and a fuel discharge port to inject pressurized fuel into the cylinder of the internal combustion engine;

a lower fuel chamber in said body adjacent said fuel discharge port and an upper fuel chamber in said body adjacent said fuel inlet port;

fuel passages connecting said upper fuel chamber and said lower fuel chamber;

an upper valve seat between said fuel inlet port and said upper fuel chamber;

a lower valve seat between said fuel discharge port and said lower fuel chamber;

a fuel injection control valve in said body mounted for movement between a closed seated position on said upper valve seat blocking fuel from said fuel inlet port to said upper fuel chamber to provide a buildup of fuel pressure at said fuel inlet port, and an open unseated position on said upper valve seat permitting fuel to pass from said fuel inlet port to said upper fuel chamber;

a fuel injection valve in said body mounted for movement between a closed seated position on said lower valve seat blocking fuel from passing said fuel discharge port, and an open unseated position on said lower valve seat permitting fuel to pass said fuel discharge port for discharge into the cylinder;

a control fluid inlet port in said body to admit the separate independent pressurized control fluid of a variable pressure for acting against said fuel injection control valve and said fuel injection valve in opposed relation to said pressurized fuel to urge said fuel injection control valve and said fuel injection valve to seated closed position on their respective seats, the control pressure of said pressurized control fluid varying continuously during operation of said engine in response to selected sensed operating conditions of said engine, the pressure of said pressurized fuel at said fuel inlet port accumulating thereat in the closed position of said fuel injection control valve and varying continuously during operation of said engine in response to the varying pressure of said pressurized control fluid from selected sensed operating parameters of said engine to permit opening said fuel injection control valve for supply of pressurized fuel to said fuel injection valve at varying fuel pressures;

said fuel injection control valve in a first step of operation first moving to unseated open position in response to a predetermined pressure differential between the accumulated pressurized fuel at said fuel inlet port and said separate independent pressurized control fluid to permit fuel to pass into said upper fuel chamber and said fuel passages to said lower fuel chamber;

said fuel injection valve in a second step of operation then moving to unseated open position in response to a predetermined pressure differential between the pressurized fuel at said lower fuel chamber and the separate independent pressurized control fluid for the injection of fuel from said fuel discharge port;

said fuel injection control valve in a third step of operation next returning to closed seated position on said upper valve seat in response to a predetermined pressure differential between the pressurized fuel in said upper fuel chamber and the separate independent pressurized control fluid thereby to block fuel passing from said fuel inlet port to said upper fuel chamber; and said fuel injection valve in a fourth step of operation then moving to closed seated position on said lower valve seat in response to a predetermined pressure differential between the pressurized fuel in said lower fuel chamber and the separate independent pressurized control fluid to block fuel passing to said fuel discharge port from said lower fuel chamber;

whereby a cycle of operation of the fuel injection element is completed successively by said steps with variable time intervals between successive steps.

20. A fuel injection element is set forth in claim 19 wherein mechanical spring means urge said fuel injection control valve and said fuel injection valve to seated closed position on their respective valve seats.

21. A fuel injection element as set forth in claim 19 wherein said fuel injection control valve and said fuel injection valve each comprises an elongate reciprocal valve member, and said separate pressurized control fluid of a continuously varying pressure acts directly against said elongate reciprocable valve members.

22. A fuel injection element for the injection of fuel into a cylinder of an internal combustion engine and operated in response to pressure differentials between pressurized fuel and a separate pressurized control fluid of a variable pressure dependent on selected sensed operating conditions of the engine; said fuel injection element comprising:

a body having a fuel inlet port where fuel pressure accumulates and a fuel discharge port to inject pressurized fuel into the cylinder of the internal combustion engine;

a lower fuel chamber in said body adjacent said fuel discharge port;

a fuel passage connecting said fuel inlet port and said lower fuel chamber;

a fuel injection control valve in said body mounted for movement between a closed position blocking fuel from passing said fuel inlet port to said lower fuel chamber to permit an accumulation of fuel pressure at said fuel inlet port, and an open position permitting fuel to pass said fuel inlet port to said lower fuel chamber through said fuel passage with the fuel accelerating in said passage;

a fuel injection valve in said body mounted for movement between a closed position blocking fuel from passing to said fuel discharge port from said lower fuel chamber, and an open position to permit fuel to pass to said discharge port from said lower fuel chamber; and a control fluid inlet port in said body to admit the separate pressurized control fluid for acting against said fuel injection control valve and said fuel injection valve to urge said fuel injection control valve and said fuel injection valve to closed position, the pressure of said pressurized control fluid varying continuously during operation of said engine in response to selected sensed operating conditions of said engine, the pressure of said pressurized fuel supplied to said fuel inlet port accumulating thereat and varying continuously during operation of said engine in response to the varying pressure of said pressurized control fluid to permit opening of said fuel injection control valve at varying fuel pressures at said fuel inlet port for supply of fuel to said fuel injection valve.

23. A fuel injection element as set forth in claim 22 wherein:

said fuel injection control valve in a first step of operation first moves to unseated open position in response to a pressure differential between the accumulated pressurized fuel at said fuel inlet and said separate pressurized control fluid to permit fuel to pass into said fuel passage to said lower fuel chamber;

said fuel injection valve in a second step of operation then moves to open position in response to a pressure differential between the pressurized fuel in said lower fuel chamber and the separate pressurized control fluid for the injection of fuel from said fuel discharge port;

said fuel injection control valve in a third step of operation next returns to closed seated position in response to a pressure differential between the pressurized fuel in said fuel inlet port and the separate pressurized control fluid thereby to block fuel from said fuel inlet port to said fuel passage; and said fuel injection valve in a fourth step of operation then returns to closed seated position in response to a pressure differential between the fuel in said lower fuel chamber and the separate pressurized control fluid to block fuel passing to said fuel discharge port from said lower fuel chamber;

whereby a cycle of operation of the fuel injection element is completed successively by said steps with variable time intervals between successive steps.

24. A method for the injection of fuel from a fuel injection element into a cylinder of an internal combustion engine; said method comprising the following steps:

providing a fuel injection body having a fuel inlet port for pressurized fuel and a control fluid port for a separate pressurized control fluid;

providing a fuel injection valve in said injection body between the fuel inlet port and a fuel discharge port and mounted for movement between a seated closed position blocking fuel from passing to the fuel discharge port, and an open position permitting discharge of fuel from said fuel discharge port;

providing a fuel injection control valve in said injection body in a fuel passage between said fuel inlet port and said fuel discharge port upstream of said fuel injection valve and movable between a seated closed position blocking fuel passing from said fuel inlet port to said fuel injection valve to permit the accumulation of fuel pressure at said fuel inlet port, and an open position permitting fuel to pass from said fuel inlet port to said fuel injection valve;

supplying pressurized control fluid to said control fluid port at a variable pressure dependent on sensed operating conditions of the engine with said pressurized control fluid acting against said fuel injection valve and said fuel injection control valve in a direction opposed to said pressurized fuel; the pressure of said pressurized control fluid varying continuously during operation of the engine in response to selected sensed operating conditions of said engine;

supplying pressurized fuel to said fuel inlet port at a variable supply pressure dependent on the pressure of said pressurized control fluid from sensed operating conditions of said engine, and effecting a buildup of fuel pressure at said fuel inlet port in a closed position of said fuel injection control valve;

unseating said fluid injection control valve at a predetermined pressure differential between the pressurized fuel accumulated at said inlet port in the closed position of said fuel injection control valve and the separate pressurized control fluid at said control fluid port to permit fuel to pass to said fuel injection valve; and then unseating said fuel injection valve in said injection body at a predetermined pressure differential between the pressurized fuel supplied to said fuel inlet port and the separate pressurized control fluid supplied to said control fluid port for the injection of fuel from said fuel discharge port.

25. The method as set forth in claim 24 further including the step of:

next returning said fuel injection control valve to a closed seated position in response to a pressure differential between the pressurized fuel supplied to said fuel inlet port and the separate pressurized control fluid at said control fluid port for blocking fuel from passing said fuel inlet port into said fuel passage.

26. The method as set forth in claim 24 further including the step of:

providing a relatively long fuel passage be(ween said fuel injection control valve and said fuel injection valve for the acceleration of fuel from said fuel injection control valve to said fuel injection valve upon the opening of said fuel injection control valve.

* * * * *